United States Patent [19]

Nicolai et al.

[11] 4,188,580

[45] Feb. 12, 1980

[54] SECURE COMMUNICATION SYSTEM

[75] Inventors: Carl R. Nicolai, Seattle, Wash.; William M. Raike, Carmel, Calif.; David L. Miller, Seattle, Wash.

[73] Assignee: Telesync Corporation, Carmel Valley, Calif.

[21] Appl. No.: 843,800

[22] Filed: Oct. 20, 1977

[51] Int. Cl.[2] ..... H04K 1/00

[52] U.S. Cl. ..... 325/32; 179/1.5 R; 325/58; 325/65; 178/69.1

[58] Field of Search ..... 325/32, 65; 179/1.5 R; 364/717

[56] References Cited

U.S. PATENT DOCUMENTS

| | | | |
|---|---|---|---|
| 3,610,828 | 10/1971 | Girard | 325/32 |
| 3,614,316 | 10/1971 | Andrews, Jr. et al. | 178/22 |
| 3,624,297 | 11/1971 | Chapman | 179/1.5 R |
| 3,659,046 | 4/1972 | Angeleri et al. | 178/22 |
| 3,694,757 | 9/1972 | Hanna, Jr. | 325/466 |
| 3,706,933 | 12/1972 | Bidell et al. | 325/32 |
| 3,723,878 | 3/1973 | Miller | 325/32 |
| 3,808,536 | 4/1974 | Reynolds | 325/32 |
| 3,893,031 | 7/1975 | Majeau et al. | 325/32 |
| 3,909,534 | 9/1975 | Majeau et al. | 179/1.5 R |
| 4,013,837 | 3/1977 | Bianscome et al. | 325/32 |

OTHER PUBLICATIONS

R. C. Dixon, *Spread Spectrum Systems*, New York, John Wiley and Sons, 1976, Chapters 1 and 2, et seq.

R. C. Dixon, *Why Spread Spectrum*, IEEE Communications Society, vol. 13, No. 4.

*Primary Examiner*—Howard A. Birmiel

*Attorney, Agent, or Firm*—Flehr, Hohbach, Test et al

[57] ABSTRACT

A secure communication system for transmitting and receiving an encoded information signal. The system generates at transmitting and receiving locations a predetermined unique pseudorandom code. A synchronized tracking signal is imposed on the information to be transmitted and added to the information to form an intermediate signal. The pseudorandom code is then multiplied by the intermediate signal directly so that the ultimate result appears to assume the character of pseudorandom noise, which is then transmitted to the receiving location. The synchronization and transmitted encoded portion is decoded at the receiver and used to generate a base signal for a pseudorandom generator at the receiving location, as well as initiate initial clocking pulse time for operation of the receiver pseudorandom generator. The receiver then generates the predetermined pseudorandom code and divides the same against the encoded signal being received to form an intermediate signal having no pseudorandom signal component, which is then filtered to remove the tracking and masking signal and thereby generating the original information signal desired.

16 Claims, 11 Drawing Figures

SECURE COMMUNICATION SYSTEM

BACKGROUND OF THE INVENTION

The present invention relates to communication systems for the transmission of information in secure form and more particularly to such systems in which the information signal is coded by a transmitter and decoded by the receiver at the respective transmit and receive location, the communication between the locations being by any suitable means such as telephone, radio, or other communication systems.

Heretofore, systems have been proposed by which the transmission of information signals may be rendered secure and difficult to decode. Among the proposals heretofore made have included the use of pseudorandom digital generators at the receive and transmit locations, which generators may be caused to operate in synchronization and on the same pseudorandom code base so that the receiver and transmitter can be locked together. Several proposals have been made for ways in which this can be implemented. More specifically, spread spectrum techniques have been proposed and are summarized, for example, in the book by R. C. Dixon entitled *Spread Spectrum Systems* published by John Wiley & Sons, New York, 1976.

In a typical spread spectrum system a base band signal, say a voice channel, of perhaps only a few kilohertz, is distributed over a band of carrier frequencies that may be many MHZ wide. Often the spread spectrum technique leads to modulation of a carrier by frequency shifting or frequency hopping techniques according to a pre-determined pseudorandom code or pulsed FM chirp modulation in which the carrier is swept over a wide band during a given pulse interval. In general, the systems as used in spread spectrum technology require complex transmitting and receiving equipment capable of wide band operation and also require expensive frequency selective apparatus for implementation.

Other prior art systems have been proposed utilizing pseudorandom signal generators for scrambling or encoding the information signal itself for secure transmission rather than the carrier system employed in the transmission. Reference is made, for example, to U.S. Pat. No. 3,909,534 entitled VOICE PRIVACY UNIT FOR INTERCOMMUNICATION SYSTEMS, issued Sept. 30, 1975 to Henry L. Majeau, et al. In that patent it is proposed that a pseudorandom generator be used to control a frequency shift modulation device which is applied to the information signal being processed. In this way, the pseudorandom code selects from one of the modulation frequencies available and is time duration coded by them in a pseudorandom way, which resulting coded frequency pattern is mixed with the information signal before being transmitted. In the 3,909,534 patent there is required at the receiver a pseudorandom code generator controlled by an independent frequency synthesizer and suitably synchronized to the transmitter for providing a selected modulation frequency code which corresponds to that transmitted. Disadvantages to this system include the necessity for modulating the information signal with signals of varying frequency and the entire use of multi-frequency encoding according to the pseudorandom code may render the transmission less secure. Furthermore, the complexity of the transmitter and the receiver is unduly high. In addition, the synchronization of such equipment relies both on right initiation of the initial sync pulse generator and the inherent reliability and quality of the frequency generators of the transmitter and receiver.

Another system as disclosed in the U.S. Pat. No. 3,614,316 illustrates the use of direct sequence system requiring two pseudorandom generators. In U.S. Pat. No. 3,614,316 the information signal is used to phase modulate one of the pseudorandom generators which is then operated to transmit the sum of the two generators as the encoded information. Obviously, the requirement of the use of two pseudorandom generators results in a complex and costly system. There is, therefore, a need for a new and improved communication system which will provide for secure communications between transmit and receive locations.

SUMMARY OF THE INVENTION & OBJECTS

In general, it is an object of the present invention to provide a new and improved communication system which is inherently simple and reliable.

Another object of the invention is to provide a communication system of the above character which utilizes a pseudorandomly generated code at transmit and receive locations which are synchronized to each other but which employs the use of the code in a novel way which is simple, direct and effective while being inherently low cost.

Another object of the invention is to provide a communication system of the above character in which all listeners will receive only noise signals during transmission, excepting the desired receivers.

Another object of the invention is to provide a secure transmission system of the above character utilizing a direct sequence technique for mixing an information signal with a pseudorandom signal code for transmitting and decoding the same and further which is simple in construction having very few hardware components but which incorporates, nevertheless, full synchronization and tracking to thereby allow the system to maintain full compatible operation during the period of transmission and reception of signals.

The foregoing objects are achieved in accordance with the present invention by employing a transmitter and receiver device which may either be of single unitary structure in which the transmitter and receiver components form a transceiver at each location, or may be structured so as to employ distinct transmitter and distinct receiver in character at each location, i.e. modified to either supply solely transmitter or receiver functions and packaged in that manner if so desired. In the embodiment illustrated herein a transceiver structure is disclosed.

Thus, there is provided herein a communication system in accordance with the present invention which operates by using the following procedure: First, there is generated a pre-determined unique pseudorandom code in exclusively digital form at both the transmit and receive stations. The code is of typical pseudorandom character and can be generated by any of a wide variety of techniques. However, it is user selectible in the sense that it has a predetermined character over a length of time long in comparison with the length of the transmitted signal. Each of the generated codes is pre-selectible so that the transmitter and the receiver are pre-set to use identical codes. A synchronized tracking signal is imposed upon the information to be transmitted in an initial phase such as by generating a synchronized tracking signal and adding the same to the information to form thereby an intermediate signal. The pseudorandom code is then mixed or multiplied by the intermediate signal directly so that the ultimate result appears to assume the character of pseudorandom noise, which ultimate signal is transmitted from the transmit to the receive station either directly or by a suitable carrier or other communication channel. The synchronization and transmitted encoded portion added to the information signal is decoded at the receiver and used to generate the base signal for the pseudorandom generator there as well as to initiate the initial clocking pulse time for initiation of the operation of the receiver pseudorandom generator. The receiver then generates the predetermined pseudorandom code and mixes or divides the same against the encoded signal being received. The output of the receiver is an intermediate signal having no pseudorandom signal component provided both the transmitter and receiver remain in sync and on the same predetermined code. This intermediate signal is then filtered to remove the tracking (and masking) signal and thereby generate the original information signal desired. In the present invention, a signal detected by third parties will appear to be nothing more than pseudorandom noise. The present invention is characterized by the multiplication, i.e. modulation or mixing together in an analog system of a digital signal and an analog information signal and the transmission and detection of the encoded result.

These and other objects and features of the invention will become apparent from the following detailed description when taken in conjunction with the accompanying drawings.

DETAILED DESCRIPTION

Before going into a detailed description of the figures a brief overview will be given describing the general operation of the transmitter and receiver.

When an operator desires to transmit an encoded information signal, depressing a push-to-talk switch will activate circuitry which initially generates a synchronization or burst signal which is transmitted to a receiver. The synchronization signal is also known as a synchronizing preamble code for appropriately informing a receiver to expect the transmission of encoded information. The synchronization signal is transmitted for a brief period of time which can be determined for example by a one shot multivibrator or a digital counter. Both the transmitter and receiver detect when the synchronization signal has in fact terminated.

Based upon such detection, both the transmitter and receiver will begin generating a predetermined pseudorandom signal code which is identical at both the transmitter and receiver.

The pseudorandom code is multiplied with an intermediate signal (the information signal plus the tracking signal) and the resultant signal is transmitted to the receiver.

The function of the receiver is to remove the pseudorandom signal code from the encoded information at the receiver. This is done by multiplying the received signal by the pseudorandom signal code, which is identical to that generated at the transmitter.

This intermediate signal, which still contains the tracking signal, is then filtered to remove the tracking signal, thereby reproducing the original information.

As an additional function, the tracking signal is added to the information signal during transmission to perform a masking function, which effectively provides further privacy and security of the transmitted information. Additionally, the masking signal also serves as a tracking signal, which enables the receiver to continuously generate the pseudorandom signal code at the same rate that the transmitter is generating the identical code. This enables the receiver to continuously recover the information.

Additionally, the presence of the tracking/masking signal in the intermediate signal serves as a lockout signal to prevent unintentional resynchronization; when said signal is not being detected and applied to the lockout switch, the receiver will accept and convey to the speaker non-encoded information until another properly encoded signal is detected and recognized.

Figure 1:
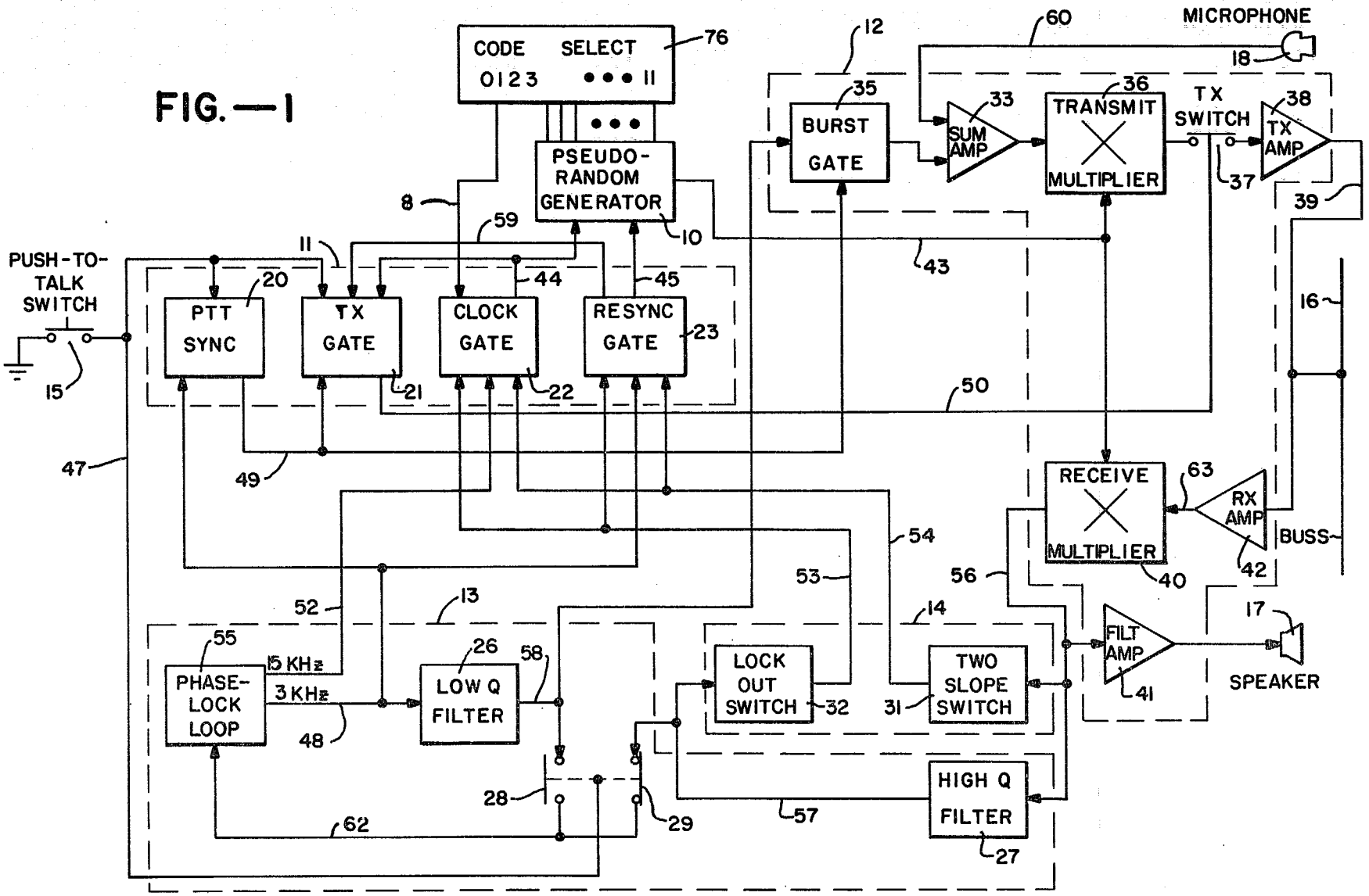
FIG. 1, depicts a block diagram of a secure communication system of the present invention.

Referring to FIG. 1, the block diagram of one embodiment of the present invention is shown.

In FIG. 1, a transmitter/receiver is illustrated and it will be understood that the system is capable of both transmission and reception in one embodiment. However, a separate transmitter or receiver is within the scope of the present invention.

In FIG. 1, a pseudorandom signal generator 10 generates upon appropriate enablement a pseudorandom signal code for encoding an information signal.

Figure 4:
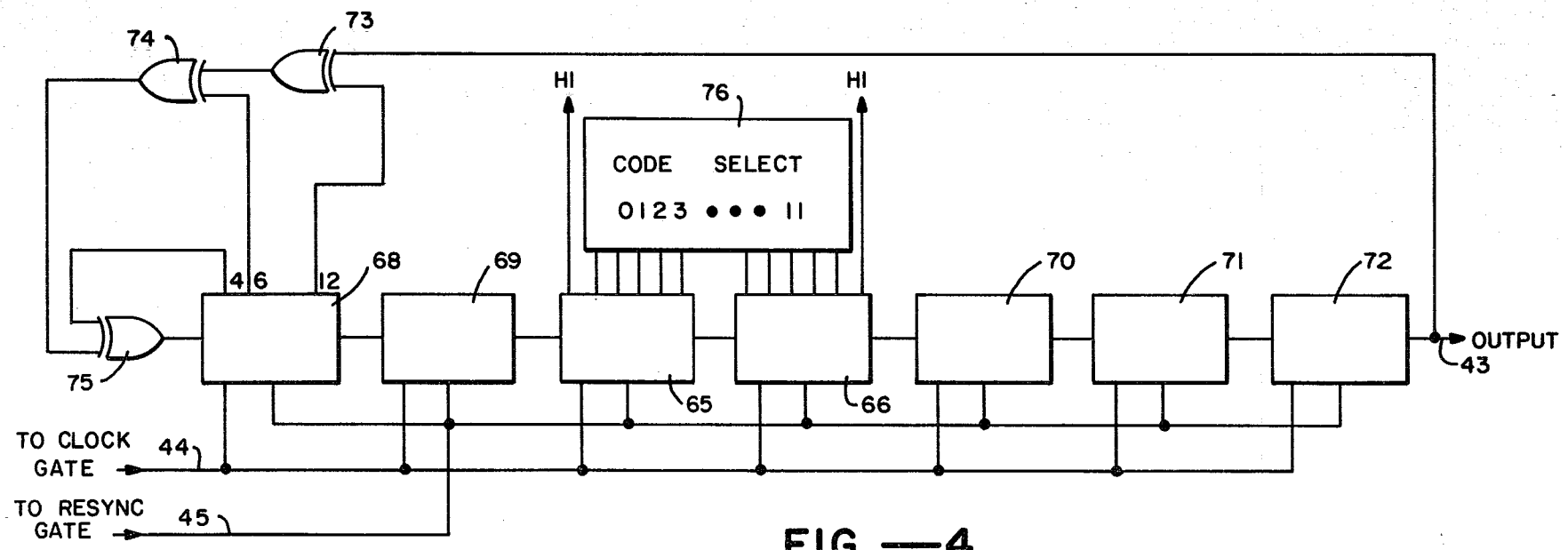
FIG. 4, depicts a pseudorandom signal generator circuit, which forms a portion of FIG. 1.

The pseudorandom signal generator 10 shown in more detail in FIG. 4, comprises seven 8-bit shift registers 65–66, 68–72 and has the capability of generating a sequence $(2^{56}-1)$ bits long. The generator is loaded with a fourteen-bit, predetermined user selectible starting code from code select 76. Any one of $2^{14}$ start codes selected will cause a signal pattern of pulses to be generated which takes an extremely long time to repeat—for example, thousands of years. The high order and low order bits of the shift registers into which the starting code is loaded, are wired high to insure distinctness and separation of the codes generated.

The 14-bit starting code is loaded into parallel-to-serial registers 65,66, with the high order pin of 65 and the lower order pin of 66 wired high to insure the above mentioned code uniqueness. The code is stepped through registers 70–72 and to the DM circuit via bus 43 at a rate determined by the clock signal on bus 44. The code is also fed back to gates 73, 74, 75 and exclusively ORed with the output pins 12, 6, 4, respectively, of register 68. This will vary the output to form a pseudorandom code that takes many thousands of years to repeat. Other variations of generator 10 are possible.

The resync signal on bus 45 will reset the SG 10 circuit.

The gating module (GM) 11 of FIG. 1, includes a PTT sync circuit 20, a transmission gate (TX gate) 21, a clock gate (C gate) 22, and a resync gate 23. The gating module controls the instant at which the SG 10 begins a sequence.

The tracking module 13 includes a phase lock loop (PLL) circuit 55, a low Q filter 26, a high Q filter 27 and conventional analog switches 28, 29 (CMOS 4016). The purpose of the tracking module 13 is to establish and maintain coherence between the transmitter and receiver pseudorandom generators.

Figure 11:
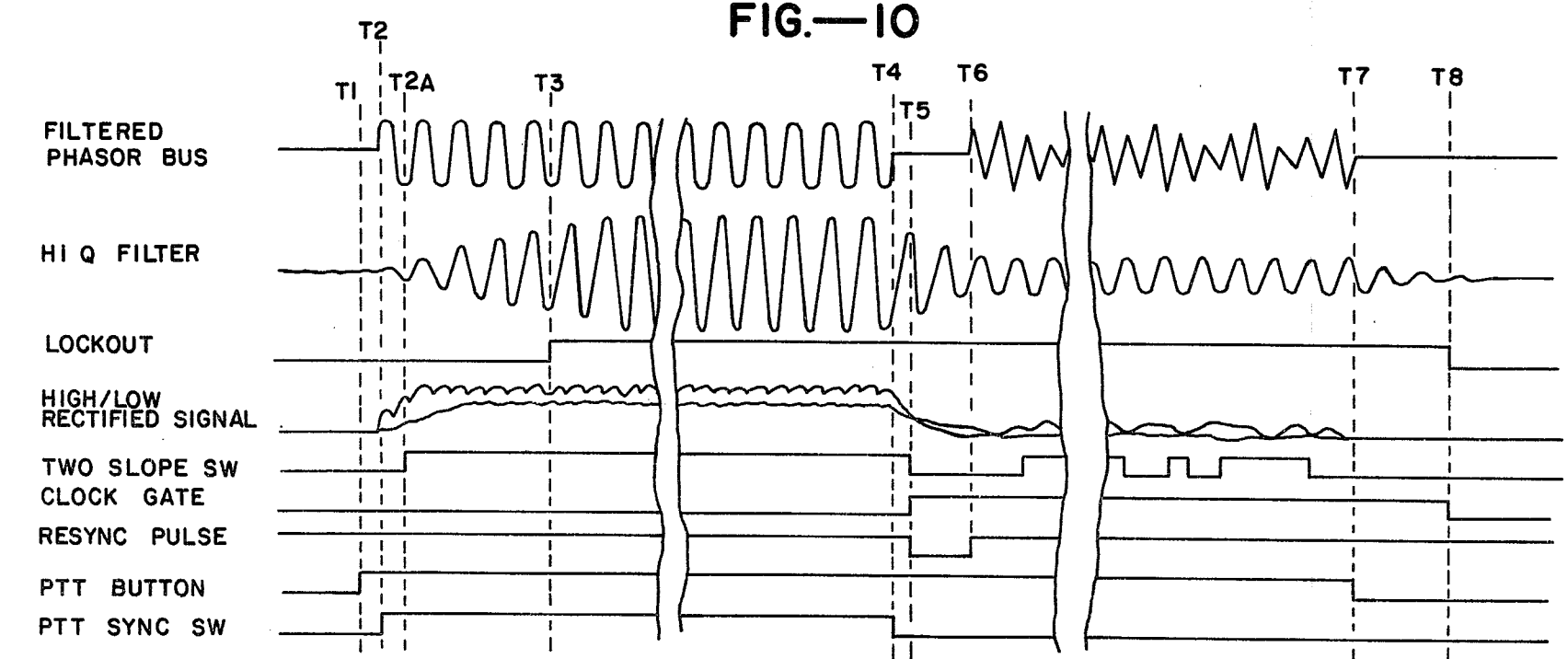

The dual switch circuit 14 includes a two slope detector circuit 31 for generating the two slope signal as seen in FIG. 11 and a lockout switch circuit 32 for generating the lockout signal of FIG. 11.

The dual multiplier circuit DM 12 includes a transmitter multiplier 36, receiver multiplier 40, conventional inverting amplifier 38, audio amplifier/notch filter 41, and analog switches 35, 37. A speaker 17 is connected to the amplifer/notch filter 41.

One output of the dual multiplier circuit 12 is bus 16 which could be connected to either a conventional antenna, communication wire, or other form of channel for transmitting and receiving encoded information.

The dual multiplier circuit 12 receives as one input the pseudorandom signal code on bus 43, which is input to the transmitter multiplier TM 36 and receiver multiplier RM 40. The dual multiplier 12 provides for encoding the information signal to be transmitted and for decoding the received encoded information. The dual multiplier module, via amplifier/filter 41, also removes the tracking signal which has been added to the encoded information.

The GM 11 circuit includes as one input a push to talk (PTT) signal, which is input to the PTT Sync 20 and transmission gate 21 circuits when an operator desires to transmit encoded information. The PTT signal is seen occurring at time T1 in FIG. 11.

The PTT Sync circuit 20 includes a conventional one shot multivibrator (74121) (not shown). Inputs to PTT Sync 20 are the PTT signal on bus 47 and a sync signal on bus 48 from PLL 55. The Q output (not shown) of PTT Sync 20 on bus 49 is the PTT Sync signal as depicted at time T2 in FIG. 11. The output of PTT Sync circuit 20 on bus 49 is one input to the TX gate 21 circuit and also to the switch 35 in the DM 12 circuit.

Figure 7:
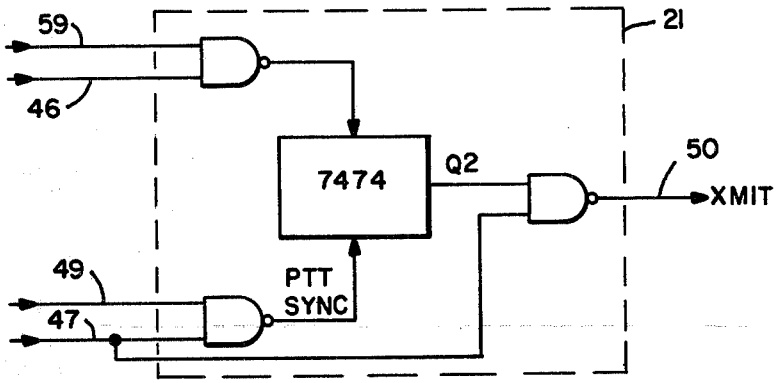
FIG. 7, depicts a transmit gate, which forms a portion of FIG. 1.

The T gate 21 includes a conventional flip-flop (7474) as seen in FIG. 7, which has as its clear input the PTT Sync signal on bus 49 NANDed with the $\overline{\text{PTT}}$ signal on bus 47. The preset input to T gate 21 is the $\overline{\text{Q}}$ output (not shown) of PTT Sync 20 on bus 49 NANDed with a RS gate 23 output on bus 59, which enables the T gate to transmit. The $Q_2$ output of T gate 21 is NANDed with the PTT signal to form the XMIT signal on bus 50.

The output of the T gate 21 circuit on bus 50 is input to which 37 in the DM 12 circuit thereby enabling the transmitter portion of the system.

In FIG. 1, the C gate 22 receives 3 inputs as follows. One input is a clock signal on bus 52 from the PLL 55 circuit, which in one embodiment is a 15 KHz signal. Another input on bus 53 is from the lockout switch 32. The last input is on bus 54 from the two slope switch 31.

The PTT signal on bus 47 enables analog switch 28 which is connected to the low Q filter 26 via bus 58, or analog switch 29, which is connected to high Q filter 27 via bus 57.

The outputs of switches 28, 29 are coupled to phase lock loop 55 via bus 62.

The PLL circuit 55 includes a conventional phase lock loop integrated circuit, such as Signetics' NE 565. A phase lock loop circuit can achieve frequency multiplication by locking, for example, on to a harmonic of an input signal.

The phase lock loop 55 circuit is used to generate a synchronization and masking signal on bus 48 and a clock signal on bus 52 through techniques which are well known.

In one embodiment, the clock signal is a 15 KHz and the synchronization/masking signal is 3 KHz. Other variations of the clock and synchronization/masking signals are possible. For example, both clock and synchronization/masking signals could be lower frequency (e.g. 1 KHz) signals.

The functions of the synchronization/masking and clock signals generated by the PLL 55 circuit will be described below.

The low Q filter 26 and high Q filter 27 include conventional operational amplifiers (LM 747) for providing appropriate filtering as will be described in conjunction with the timing diagram of FIG. 11.

The tracking module 13 circuitry has an input into switches 28, 29 from the PTT button via bus 47.

The low Q filter circuit is connected to PLL 55 via bus 48. An output of low Q filter 26 is to switch 28 and gate 35 via bus 58.

An input to high Q filter 27 is from bus 56 in the DM 12 circuit and an output of the high Q filter 27 is input to switch 29 and lock out switch 32 via bus 57.

Figure 5:
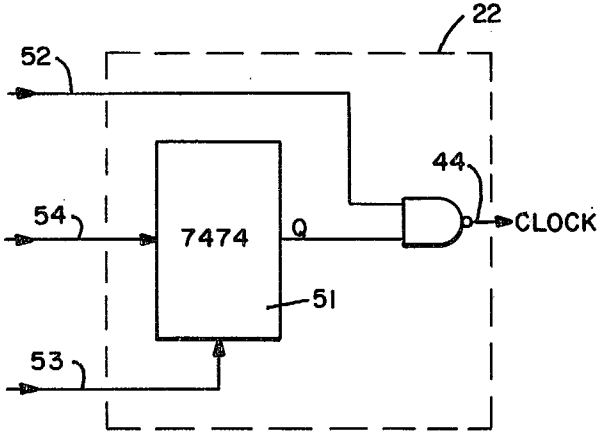
FIG. 5, depicts a clock gate, which forms a portion of FIG. 1.

In FIG. 5, the C gate includes a flip-flop 51 (7474) with the two slope signal input on bus 54 as a clock and the lockout signal input on bus 53 as a clear. The Q output of flip-flop 51 is NANDed with a clock signal on bus 52 from the PLL 55 circuit, thereby forming the clock signal on bus 44 to SG 10 and TX gate 21. In one embodiment the clock signal is a 15 KHz signal used to clock the pseudorandom code from the SG 10.

The resync gate 23 has one output on bus 45 to the SG 10 circuit. Three inputs to the resync gate 23 are from the lockout switch 32 on bus 53, the two slope switch 31 on bus 54, and the sync signal on bus 48.

Figure 6:
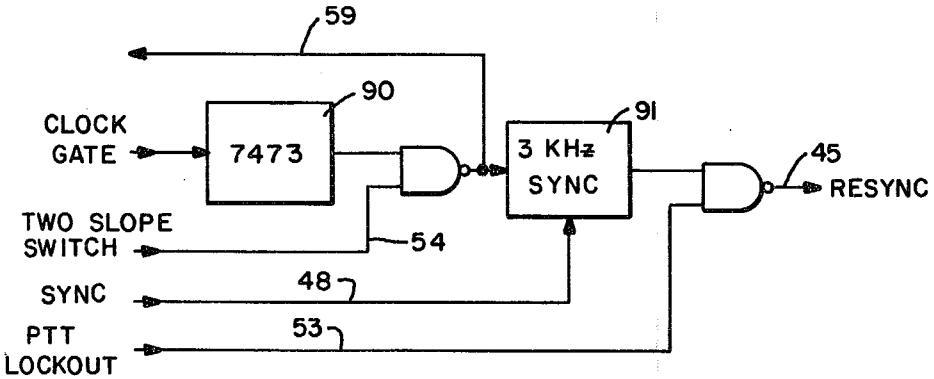
FIG. 6, depicts a resync gate, which forms a portion of FIG. 1.

In FIG. 6, the resync gate 23 includes a one-shot 90 (7473) with an input from the clock gate 22. The output of one-shot 90 is NANDed with the two slope signal on bus 54 and input to sync circuit 91 (7473). The sync signal on bus 48 is input to sync circuit 91 and the output of sync circuit 91 is NANDed with the lockout signal to form the resync signal on bus 45.

In FIG. 1, the two slope switch 31 has an input on bus 56 from the dual multiplier 12. The lockout switch 32 has an input on bus 57 from the high Q filter 27. The output connections of the two slope switch 31 and lockout switch 32 have previously been described.

The dual multiplier circuit DM 12 has one input on bus 58 from the low Q filter 26, which in this embodiment comprises the tracking/masking signal. Another input to the DM circuit on bus 60 is the audio information signal from a conventional microphone 18.

Switch 35 receives an input from bus 49 which is a signal from the PTT Sync gate 20.

The switch 35 in the DM 12 circuit also receives a synchronization/masking sinewave from the low Q filter on bus 58 added in summing AMP 33 to the information from microphone 18 on bus 60. The result serves as one input to the transmitter multiplier 36. When enabled by PTT sync signal on bus 49, the level of the 3 KHz sinewave is increased. This forms the sync burst. The output of TM 36 is input to switch 37 which, when enabled by XMIT signal on bus 50 from T gate 21, passes a signal through conventional amplifier 38 to bus 16, by way of bus 39. Also, the signal is input to receiver multiplier 40 through AMP 42 for connection back via bus 56 to the high Q filter 27 and two slope switch 31.

The dual multiplier 12 utilizes analog switches and operational amplifiers for performing the multiplication functions as will be described. The multiplication function can be viewed as a modulation of the code by the information.

Figure 3:
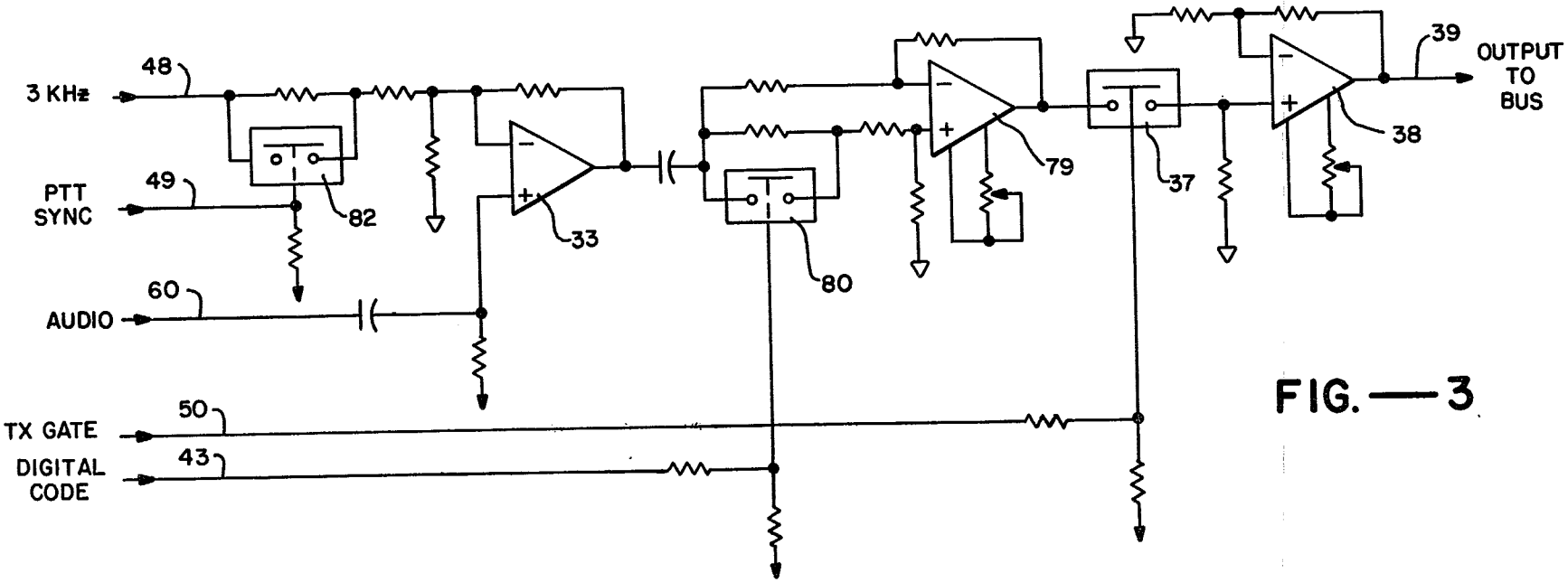
FIG. 3, depicts a transmitter multiplier circuit, which forms a portion of FIG. 1.

In FIG. 3, the transmitter multiplier 36 includes a conventional operational amplifier 79 (LM 747) and an analog switch 80 to perform multiplication of the pseudorandom code by intermediate signal comprising the audio information signal pluse tracking/masking signal.

It has been observed that by taking an analog signal such as the intermediate signal above and phase-inverting it by a signal which is either a zero or a one (a digital signal), a single operational amplifier and analog switch can be used to achieve the multiplication of those two signals. Such a circuit can achieve four quadrant multiplication without using more expensive analog multipliers. This is due to the fact that modulo two addition and four quadrant multiplication are isomorphic (functionally equivalent), a fact not usually acknowledged in the technical literature.

In FIG. 3, the sync/masking signal on bus 48 is input to switch 82 which is enabled by the PTT Sync signal on bus 49. The audio information on bus 60 is added to the sync signal in amplifier 33 to form an intermediate signal and input to the TM 36 circuit. The pseudorandom code on bus 43 is multiplied with the added signal and output from the TM 36 circuit.

In FIG. 1 the output of the transmitter multiplier 36, which is the encoded signal to be transmitted, is transmitted through analog switch 37 which is enabled by the XMIT signal on bus 50. This output signal is then passed through conventional amplifier 38 and output to bus 16 for transmission and input to bus 63 for connection to RM40 to provide side tone so that transmissions can be self-monitored.

Figure 2:
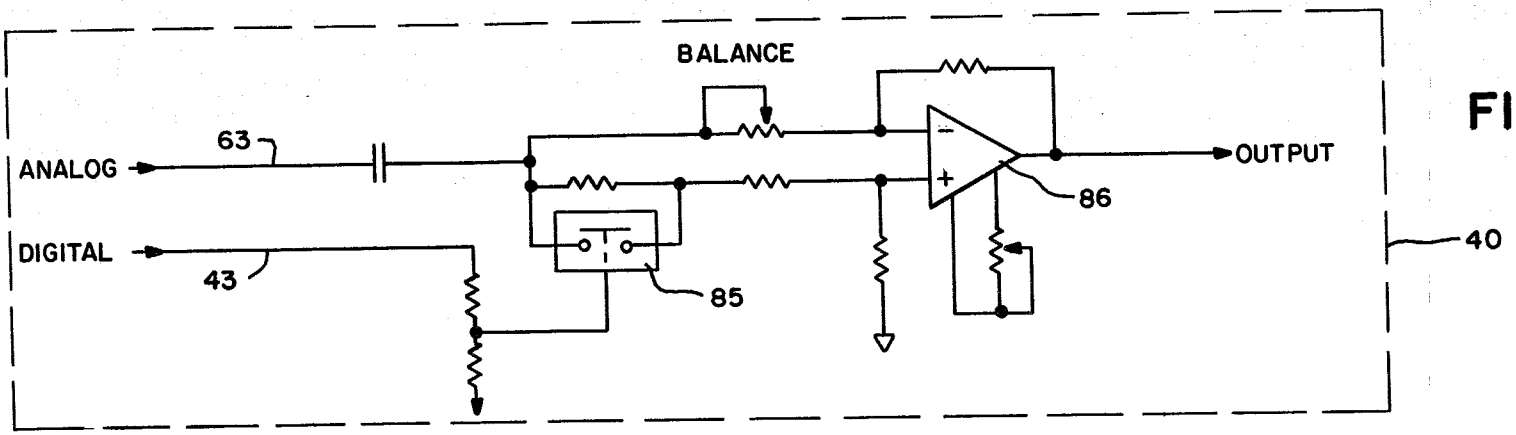
FIG. 2, depicts a receiver multiplier circuit, which forms a portion of FIG. 1.

Referring now to the receiver multiplier circuit 40 of FIG. 2, the input on bus 63 and the code on bus 43 are input to RM 40 which functions in a fashion similar to that of the transmitter multiplier 36 in that multiplication of an analog signal with a digital signal can be performed with a linear operational amplifier and a single analog switch.

The inputs to the receiver multiplier 40 are the encoded information on bus 63 and the coded pseudorandom signal on bus 43 generated by the SG 10. The input of the two signals into RM 40 will result in a "dividing" of the encoded information signal by the pseudorandom code so that the pseudorandom code is "divided out", (multiplicatively correlated) leaving only the information and any masking/tracking signals. The intermediate signal on bus 56 is input to the amplifier/notch filter 41 where the masking signal is notched out, and is also an input to the high Q filter 27 on bus 56 where it serves as the tracking signal and as the lockout signal.

The lockout switch 32 includes a conventional dual op amp (747) which receives on bus 57 the output of the high Q filter 27. When the output of the high Q filter 27, as depicted in FIG. 11, has reached a predetermined level, the lockout switch 32 will change state, as indicated by time T3. The lockout circuit is, in effect, preparing the rest of the system to prepare for the termination of the sync burst, as seen in FIG. 11.

Figure 8:
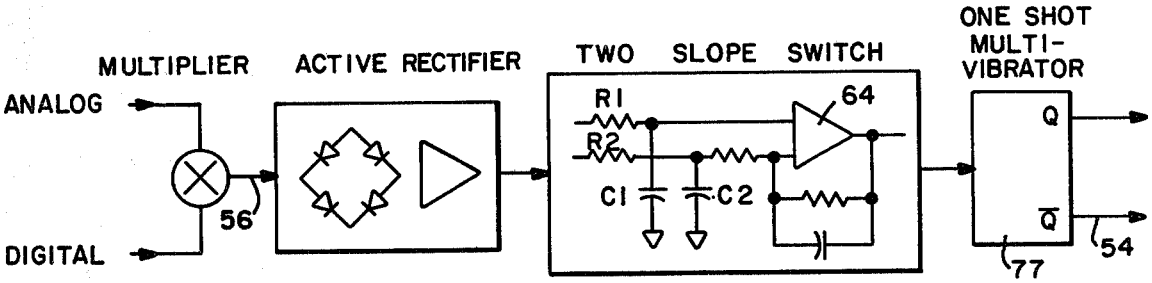
FIG. 8, depicts a two slope switch, which forms a portion of FIG. 1.

The two slope switch 31 in FIG. 8 is connected to receive from the dual multiplier circuit 12 on bus 56 the burst or synchronization signal. The two slope switch includes two RC integrator circuits with different time constants R1C1 and R2C2 for forming a rectified low integrated sync/masking and a rectified high integrated sync/masking signal as depicted in FIG. 11. A conventional op amp 64 acts as a comparator to indicate, as depicted at T5 in FIG. 11, when the burst or synchronization signal which has been terminated has decayed sufficiently in the two slope switch such that the comparator output will be an input to a conventional one shot multivibrator 77 (74121) which will change state at time T6. (A digital counter could also be used). The time between T6 and T5 in FIG. 11 is determined by the duration of the one shot multivibrator in the two slope switch and by the phase of the burst signal.

In FIG. 1, when the operator depresses the push to talk button 15, the phase lock loop 55 circuitry will be slaved to the low Q filter 26. Phase lock loop 55 generates through conventional techniques a sync/masking square wave, which is filtered to a sinewave by the low Q filter for transmission through the dual multiplier 12 via bus 58. If the signal generator 10 is not generating the pseudorandom code signal, i.e. during the sync-burst, the sync-burst signal is transmitted through the DM 12 circuit to bus 16 for transmission. Also, the burst or synchronization signal is input to the transmitter's receiver/section of the dual multiplier 12 on bus 63 to RM 40. This sync signal is then input on bus 56 to the two slope detecter 31 and the high Q filter 27.

The transmitted signal at a separate receiver and the transmitter's receiver are effectively receiving this synchronization signal at the same time. The synchronization or burst signal is of a predetermined period or number of cycles and is terminated in this embodiment by the one shot multivibrator in the PTT Sync circuit 20.

The two slope detector will determine at the appropriate time when the burst signal has in fact terminated. At this time, the two slope switch 31 will initiate a resync pulse through a one shot multivibrator (74121) to the C gate 22 and RS gate 23 in conjunction with the rising edge of the sync signal on bus 48. This will reset the pseudorandom signal generator 10 and begin clocking pulses on bus 44 to generate the pseudorandom code.

The information signal through microphone 18 and the added track signal from bus 58 is multiplied with the pseudorandom code at TM 36 for transmission.

Assuming that block diagram in FIG. 1 is for a receiver receiving the transmitted signal, the transmitted burst or synchronization signal is detected by two slope detector 31. When the synchronization signal has terminated, the two slope detector 31 initiates, at the next rising edge of the signal on bus 48 a pulse which starts the pseudorandom generator, which has a predetermined code identical to that of the transmitted code.

The code on bus 43 at the receiver is applied to the RM 40 circuit, which effectively cancels or divides out or correlates the received pseudorandom signal in the encoded information thereby passing only the information signal and tracking/masking to the amplifier/notch filter 41 and speaker 17.

In order to maintain tracking at the transmitter and receiver, the masking signal is added to the audio information before multiplying the resulting signal with the pseudorandom code at the TM 36 circuit. The transmitted signal is detected at the receiver by high Q filter 27 via bus 56, resulting in an input via bus 62 to the PLL 55 circuit through switch 29. The purpose of the input to PLL 55 is for generating a clock signal, as previously described. PLL 55 connects the clock signal to the C gate 22 via bus 52 which, when enabled, clocks the SG 10 circuit. This will result in the continued synchronous generation of the pseudorandom code.

In addition to the tracking capability, the sync signal also functions as a masking signal which further insures the privacy and security of the information being transmitted.

Transmitter Mode

Figure 10:
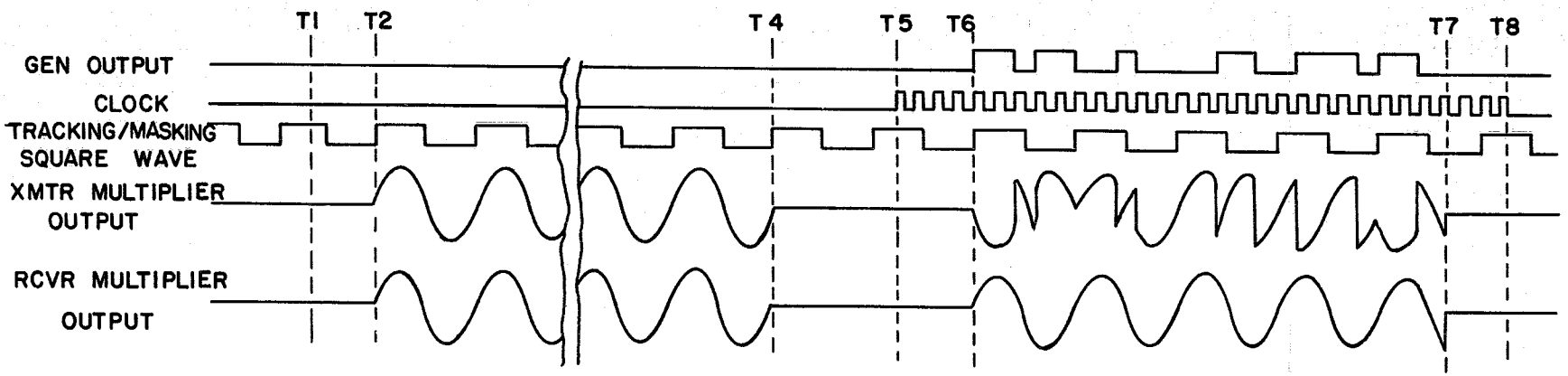
FIGS. 10 and 11 depicts timing diagrams for describing the operation of the system of FIG. 1.

Referring now to FIGS. 1, 10 and 11, the operation of the transmitter and receiver will be described starting first with a transmission cycle.

In FIG. 1, an operator depresses the push to talk button 15 which is seen as a change of state at time T1 in FIG. 11. Also at time T1, the PLL 55 is slaved to the low Q filter 26 through switch 28.

At time T2, the PTT Sync 20 circuit generates the PTT Sync signal on bus 49. The PLL circuit 55 is constantly generating the Sync tone or bus signal at this time. The PTT Sync signal is applied at time T2 to T gate 21, which will enable switch 37 in the DM circuit.

The squared signal generated by PLL 55 is applied by bus 48 to low Q filter 26 through to DM 12. Because the pseudorandom signal code is not being generated by SG 10 at this time, only the synchronization or burst signal is transmitted through TM36, switch 37, amplifier 38, and to bus 16. During transmitter operation, the 3 KHz sine wave (the filtered waveform as seen in FIG. 11) is also applied on bus 63 to the transmitter's receiver RM 40, and via bus 56 to high Q filter 27 and two slope switch 31. The two slope switch 31 has a low rectified integrated 3 KHz signal and high rectified integrated 3 KHz signal, as depicted in FIG. 11.

At time T2A the two slope switch changes state.

At time T3, the output of the high Q filter 27, which is detecting the transmitted synchronization or burst signal in the transmitter's receiver, is of sufficient magnitude to enable the lockout switch 32 to change state. This change of state is applied via bus 53 to the C gate 22 and RS gate 23 of the gating module of FIG. 1.

At time T4, the PTT Sync signal from circuit 20 changes state, as this is a predetermined period controlled by a one shot multivibrator in this embodiment. In FIG. 11 this is depicted at time T4 and therefore the synchronizing (burst) signal will no longer be transmitted.

The output of the high Q filter will be decaying in response to the termination of this synchronization signal and therefore the two slope switch 31 will provide a change of state signal at time T5 as indicated in FIG. 11.

At time T6, the clock signal from PLL 55 is enabled through C gate 22 via bus 44 by the sync pulse, and by the first rising edge of the 3 KHz square wave via bus 48. This is applied to the SG 10 circuit for generating the pseudorandom code used to encode the information signal on bus 60 and the tracking/masking signal from bus 58.

At time T6, the transmitter is now prepared to transmit the encoded information and this occurs as follows.

The sync pulse is applied from gate 23 via bus 45 to the SG 10. This resets the shift registers in SG 10 and allows for generation of the predetermined pseudorandom code.

The code is applied at time T6 to the transmitter multiplier 36 and receiver multiplier 40.

Also, the 3 KHz sine wave is applied at switch 35 and added with the audio information on bus 60. This intermediate signal is then multiplied with the pseudorandom code signal at TM 36 whereby through the multiplication or mixing techniques already described, the encoded information signal is generated. This occurs beginning at time T6 as shown in FIG. 11, and continues until the PTT button is released. The output signal is now transmitted through bus 16.

At time T7, the PTT button is released and transmission ends. However, the transition time between T7 and T8 in FIG. 11 is shown for the reason that the output of the high Q filter takes a short period in which to decay so that the lockout switch can change state.

Receiver Mode

Assume now that the circuitry of FIG. 1 is a receiver for receiving the transmitted encoded information.

The receiver circuitry will detect the synchronization burst signal being transmitted between times T2 and T4. The synchronization signal is applied to two slope detector 31 and high Q filter 27 which now causes the PLL 55 to slave to the sync burst via switch 29. When the synchronization signal has been terminated, the two slope switch changes state at T5 which, when combined with the clock signal on bus 52 forms time T6 and effectively informs the receiver to prepare for the reception of the encoded information.

Between time T5 and T6, the receiver is preparing to operate by setting the SG10 to the appropriate starting code, at substantially the same instant that the transmitter starts generating the code. This will enable the receiver to synchronously detect the pseudorandom code transmitted. At time T6, the SG 10 begins generating the predetermined pseudorandom code, which must be identical to that of the transmitter to get reception, and applies this to the receiver multiplier 40. If the generation is not identical, there will be no reception of information.

The application of the pseudorandom code to RM 40 will effectively divide out the received pseudorandom code in the signal on bus 63 and thereby transmit only the information plus the tracking signal to amplifier/notch filter 41.

The amplifier/notch filter 41 will notch out the tracking signal at this time and pass to the speaker 17 the information transmitted.

The tracking signal is applied to high Q filter 27 to phase lock loop circuit 55. As previously described, the phase lock loop circuit 55 is capable of frequency multiplication in which it will generate a clock signal in response to the tracking signal. This clock signal is applied to C gate 22 which when applied on SG10 will permit continuous synchronous generation of the pseudorandom code. The pseudorandom code applied to RM 40 will therefore continue to divide or cancel out the pseudorandom portion of the received signal, thereby allowing for continuous reception of the information and tracking signals. Fine tuning of the frequency control of the high Q filter 27 provides precise tracking adjustment.

The tracking signal also acts as a masking signal thereby performing a dual function. This masking signal insures further privacy and security of the transmitted information.

Other variations of the synchronization or preamble synchronization are possible with the present invention. Other masking signals are also possible.

Figure 9:
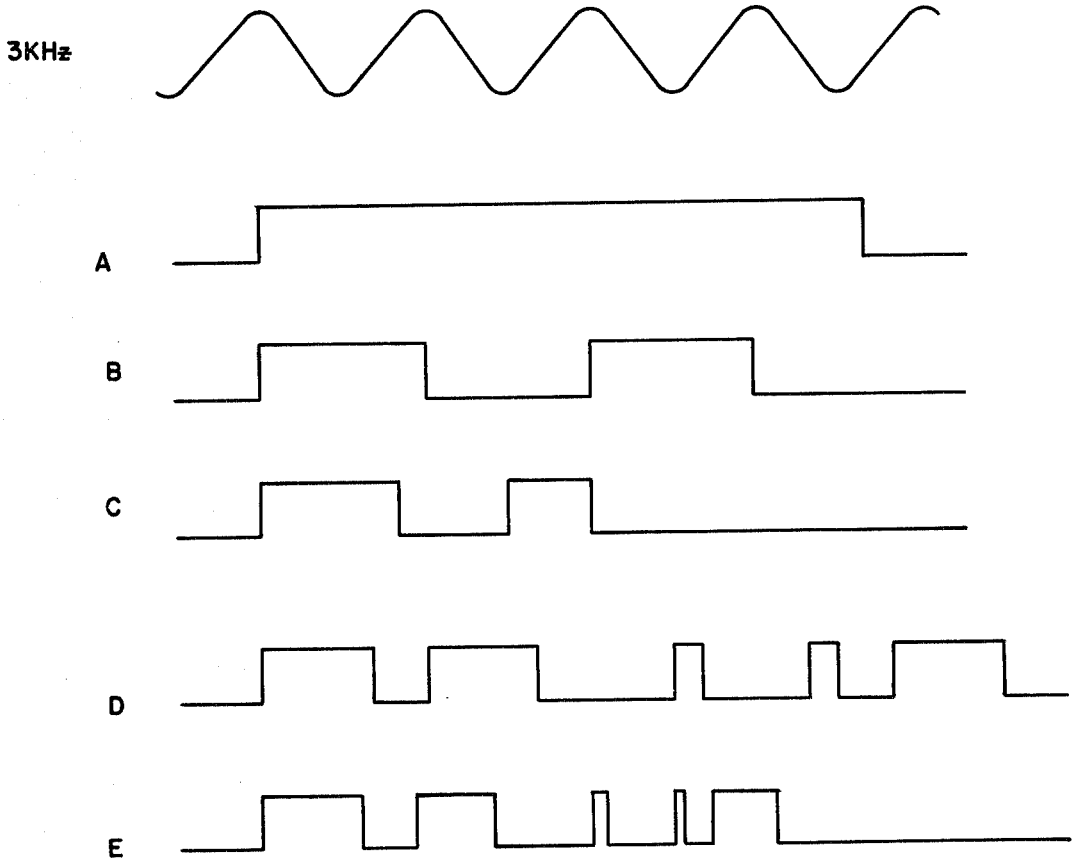
FIG. 9, depicts variations of alternative synchronization techniques for use in the present invention.

Referring now to FIG. 9, alternate synchronization schemes are depicted. In variation 9A, the synchronization scheme already described is depicted in which a sinewave is transmitted for a short duration and effectively terminated, such as at time T4 in FIG. 10.

Variation 9B utilizes a burst signal which is phase inverted once.

Variation 9C incorporates variation 9B with progressively smaller time periods between phase inverting, which is called chirp synchronization.

Variation 9D includes phase inversion in accordance with variations in a pseudorandom preamble code.

Variation 9E incorporates Variation 9D with progressively shorter code preamble periods; i.e., chirp preamble synchronization.

What is claimed is:

1. A communication system for encoding and decoding a source of information to render the communication of same secure between a transmitting location and a receiving location comprising:

means for generating predetermined user-selectible pseudorandom digital signal codes having pseudorandom first and second states at said transmitting and receiving locations, means for multiplying the information with one of said codes thereby forming encoded information, means for transmitting and receiving said encoded information, means for synchronizing the generation of said pseudorandom code at said transmitting and receiving locations, said transmitting location including means for generating a synchronizing preamble code for a predetermining period of time whereupon said preamble code becomes a tracking signal said transmitting location including means for transmitting said synchronizing preamble code and said tracking signal, said receiving location including means for detecting when said preamble code has become said tracking signal, thereby initiating generation of said pseudorandom code, said receiving location including means responsive to said tracking signal for maintaining generation of said pseudorandom code at said receiving location thereby maintaining said synchronization, and means for recovering the information from said received encoded information.

2. A communication system for encoding and decoding a source of information to render the communication of same secure between a transmitting location and a receiving location, comprising:

means for generating predetermined user-selectible pseudorandom digital signal codes having pseudorandom first and second states at said transmitting and receiving locations, means for multiplying the information with one of said codes thereby forming encoded information, means for transmitting and receiving said encoded information, means for synchronizing the generation of said pseudorandom codes at said transmitting and receiving locations, means for recovering the information from said received encoded information, said means for generating including pseudorandom shift register means for generating said pseudorandom codes and code select means connected to a specified portion of said shift register means for loading a multi-bit starting code into said shift register means, said shift register means having the bit preceding and bit following said specified portion set to said first state for insuring said user-selectible codes are separate and distinct.

3. A system as in claim 1 further including means for receiving non-encoded information when said encoded information is not being received.

4. A system as in claim 1 wherein said tracking signal becomes a masking signal for masking said transmitted encoded information and, said receiving location including means for suppressing the received masking signal.

5. A system as in claim 4 wherein said means for multiplying include transmitter multiplier means for multiplying said information with said pseudorandom code, said transmitter multiplier means including an operational amplifier connected to receive said information and an analog switch connected to said operational amplifier and connected to receive said pseudorandom digital signal code for phase inverting said information corresponding to said first and second states of said pseudorandom code thereby forming said encoded information.

6. A system as in claim 1 wherein said means for multiplying said received encoded information with said pseudorandom code, said receiver multiplier means including an operational amplifier connected to receive said received encoded information and an analog switch connected to said operational amplifier and connected to receive said pseudorandom signal code for phase inverting said received information corresponding to said first and second states of said pseudorandom code thereby recovering said information.

7. A system as in claim 1 wherein said means for synchronizing include means for generating and transmitting a synchronizing preamble code for a predetermined period of time, and means for detecting when said preamble code has ceased thereby initiating generation of said pseudorandom code, said means for detecting including first and second rectifier and integration means responsive to said synchronizing code for generating first and second rectified and integrated signals, respectively, representing different levels of said synchronizing code, and comparator means connected to compare said first and second levels and responsive thereto for initiating said pseudorandom code when said first and second level signals are equal.

8. A system as in claim 7 further including means for preventing resynchronization of said codes, including a lockout switch for generating a lockout signal when the detected synchronizing signal has reached a predetermined level thereby preventing resynchronization of said pseudorandom signal code.

9. A system as in claim 1 wherein said means for generating a synchronizing preamble code include means for phase inverting said preamble code.

10. A system as in claim 9 wherein said means for synchronizing include chirp synchronization.

11. A system as in claim 1 wherein said means for synchronizing include means for utilizing said preamble code in accordance with variations in said pseudorandom preamble code.

12. A system as in claim 11 wherein said means for synchronizing include chirp preamble synchronization.

13. A transmitter for use in a communication system for encoding a source of information to render the communication of the same secure between a transmitting location and a receiving location, comprising:

means for generating a predetermined user-selectible pseudorandom signal code, said means for generating including pseudorandom shift register means for generating said pseudorandom codes and code select means connected to a specified portion of said shift register means for loading a multi-bit starting code into said shift register means, said shift register means having the bit preceding and bit following said specified set to portion a first state for insuring said user-selectible codes are separate and distinct, means for multiplying the information with said code thereby forming encoded information, means for generating and transmitting a synchronizing preamble code for a predetermined period of time, means for transmitting the encoded information at a predetermined time in response to said synchronizing signal such that said synchronizing code becomes a masking signal for masking said transmitted encoded information and whereby said synchronizing code becomes a tracking signal continuously imposed upon said encoded information.

14. A receiver for use in a communication system for encoding and decoding a source of information to render the communication of the same secure by multiplying the information with a predetermined user-selectible pseudorandom code thereby forming encoded information for transmission between a transmitting location and a receiving location, the transmitted encoded information including a synchronizing preamble code, said receiver comprising:

means for generating a predetermined user-selectible pseudorandom signal code corresponding to the transmitted pseudorandom signal code contained within the encoded information, means for synchronizing said transmitted pseudorandom signal code and said receiver pseudorandom signal code, including means for detecting when said preamble code has ceased thereby initiating generation of said pseudorandom code whereupon said synchronizing signal becomes a tracking signal for maintaining generation of said pseudorandom signal code, said means for detecting including first and second rectifier and integration means responsive to said synchronizing code for generating first and second rectified and integrated signals, respectively, representing different levels of said synchronizing code, and comparator means connected to compare said first and second levels and responsive thereto for initiating said pseudorandom code when said first and second level signals are equal, means for recovering the information from said received encoded information, and means for receiving non-encoded information when encoded information is not being received.

15. In a communication system for encoding and decoding a source of information to render the communication of same secure between a transmitting location and a receiving location, the method comprising the steps of:

generating a predetermined user-selectible pseudorandom digital signal code at the transmitting location, generating a synchronized preamble code of predetermined duration whereupon said synchronized code becomes a tracking signal, imposing said tracking signal upon the information to be transmitted thereby forming an intermediate signal, multiplying the digital pseudorandom code directly with the intermediate signal thereby forming an encoded information signal, transmitting and receiving the synchronizing code and the encoded information signal, detecting when the synchronized preamble code has become a tracking signal thereby initiating generation of said pseudorandom code at the receiving location, multiplying the receiver digital pseudorandom code directly with the received encoded information thereby forming a received intermediate signal having no pseudorandom signal component, removing said tracking signal from said received intermediate signal said tracking signal being used to maintain sychronization between the pseudorandom code generators at said transmitting and receiving locations, and thereby recovering the information signal.

16. A communication system for encoding and decoding a source of information to render the communication of same secure between a transmitting location and a receiving location, said system comprising:

means for generating a plurality of predetermined user-selectible pseudorandom digital signal codes having pseudorandom first and second states at said transmitting and receiving locations, including pseudorandom shift register means and code select means connected to a specified portion of said shift register means for loading a multi-bit starting code into said specified portion of said shift register means, said shift register means having the bit preceding and bit following said specified portion set to said first state, means for synchronizing the generation of said pseudorandom code at said transmitting and receiving locations, including means for generating a synchronizing preamble code for a predetermined period of time whereupon said synchronizing preamble code becomes a tracking and masking signal, means for detecting when said preamble code becomes a tracking and masking signal thereby initiating generation of said pseudorandom code at said receiving location, said means for detecting including first and second rectifier and integration means responsive to the received synchronizing code for generating first and second integrated signals, respectively, representing different levels of said synchronizing code and comparator means responsive thereto for initiating generation of said receiver pseudorandom code when said levels are equal, means for imposing said tracking signal upon said information thereby forming an intermediate signal, means for multiplying the intermediate signal with one of said codes thereby forming encoded information, said means for multiplying including an operational amplifier connected to receive said intermediate signal and an analog switch connected to said operational amplifier and connected to receive said signal code for converting said information corresponding to the states of said pseudorandom code thereby forming multiplied encoded information, means for transmitting and receiving said synchronizing preamble code and said multiplied encoded information, means for multiplying the received encoded information with said receiver pseudorandom digital signal code, said means for multiplying including an operational amplifier connected to receive said received information and an analog switch connected to said operational amplifier and connected to receive said receiver signal code for phase inverting said information corresponding to the states of said receiver pseudorandom code thereby forming decoded information, means for removing said tracking signal from said decoded information signal thereby maintaining generation of said receiver pseudorandom signal corresponding to said transmitter pseudorandom signal code, means for preventing resynchronization of said codes including a lockout switch responsive to a first predetermined level of said synchronization code for generating a lockout signal thereby preventing resynchronization of said preamble code, and means for recovering the encoded information from the received intermediate signal.

* * * * *